US005180046A

United States Patent [19]

Hutton et al.

[11] Patent Number: 5,180,046

[45] Date of Patent: Jan. 19, 1993

[54] COIN DISCRIMINATION APPARATUS

[76] Inventors: Les Hutton, 5 Weir Road, Milnrow, Rochdale, Lancashire; John Kershaw, 84 Haven Lane, Moorside, Oldham Lancashire, OL4 2QH, both of England

[21] Appl. No.: 661,487

[22] Filed: Feb. 26, 1991

[30] Foreign Application Priority Data

May 24, 1990 [GB] United Kingdom ..... 9011683

[51] Int. Cl.[5] ..... G07D 5/08

[52] U.S. Cl. ..... 194/319; 307/261; 324/227; 328/28

[58] Field of Search ..... 194/317, 318, 319; 324/227, 236; 307/261, 268; 328/28, 29, 30

[56] References Cited

U.S. PATENT DOCUMENTS 4,686,385 8/1987 Sharpe ..... 328/28 X
4,754,862 7/1988 Rawicz-Szczerbo et al. ..... 194/319
4,951,800 8/1990 Yoshihara ..... 194/317

FOREIGN PATENT DOCUMENTS 2169429 9/1987 United Kingdom .

*Primary Examiner*—F. J. Bartuska

[57] ABSTRACT

Coin discrimination apparatus comprises a path (1) for passage of coins under test; sensor coils (2, 3, 4) forming an inductive coupling with a coin under test during its passage along the path, each of the sensor coils being connected in a resonant circuit (10, 11, 12) which exhibits a resonant frequency that varies in dependence upon the inductive coupling between the coil and coin, control circuitry (14) which maintains the resonant circuit at the resonant frequency while a coin under test is inductively coupled to the coil, and amplitude responsive circuitry (MPU) responsive to the change in the amplitude of an oscillatory signal developed by the resonant circuit when the coin under test passes the sensor coil to discriminate between different coins, wherein the control circuitry includes a zero crossing detector (A1) responsive to the oscillatory signal crossing a zero threshold level for producing a rectangular waveform corresponding to the oscillatory signal, and drive circuitry (FF1, 2; OR1, 2) responsive to said rectangular waveform for driving the resonant circuit to maintain resonance.

8 Claims, 3 Drawing Sheets

FIG.1
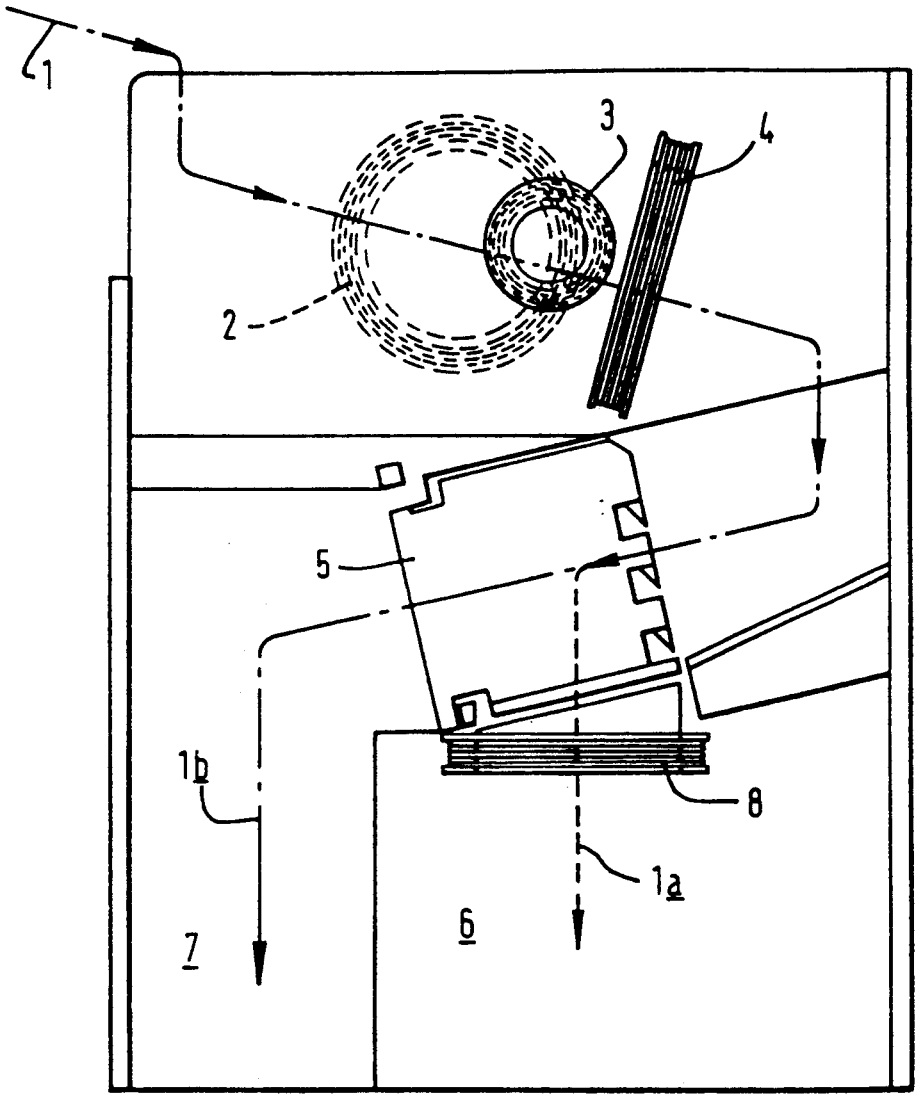
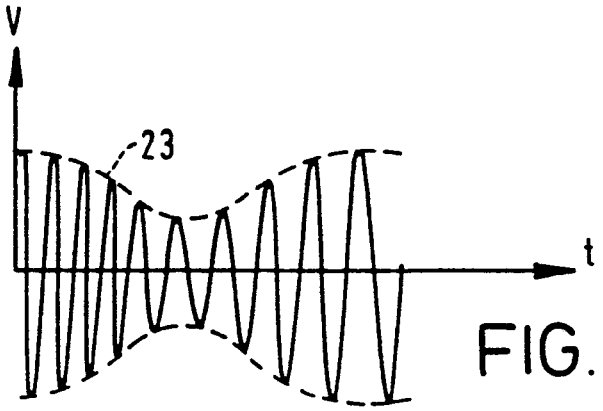
FIG.3

COIN DISCRIMINATION APPARATUS

FIELD OF THE INVENTION

This invention relates to coin discrimination apparatus and has particular but not exclusive application to a multi-coin validator.

BACKGROUND OF THE INVENTION

In a conventional multi-coin validator coins pass along a path past a number of sensor coils which are energized to produce an inductive coupling with the coin. The degree of interaction between the coin and the coil is a function of the relative size of the coin and coil, the material from which the coin is made and also its surface characteristics. Thus, by monitoring the change in impedance presented by each coil, data indicative of the coin under test can be provided. The data can be compared with information stored in the memory to determine coin denomination and authenticity.

In U.S. Pat. No. 4,754,862, assigned to the assignee of the present application, there is described coin discrimination apparatus utilising a plurality of inductive sensor coils which are each included in a respective resonant circuit. The resonant circuits are driven by a variable frequency oscillator through a multiplexer. As the coin passes a particular coil, the natural resonant frequency of the resonant circuit is altered due to the inductive coupling between the coin and the coil. The circuit is maintained at its natural resonant frequency by means of a phase locked loop which alters the frequency of the oscillator so as to track the natural resonant frequency of the resonant circuit during passage of a coin past coil. As a result, the amplitude of the oscillatory signal developed across the resonant circuit varies substantially on a transitory basis. The amplitude deviation produced by passage of the coin past the coil is a function of coin denomination. It has been found that by using three coils of different sizes and configurations, three coin signals can be provided which uniquely characterize coins of a particular coin set e.g. the UK coin set.

The amplitude deviations produced by the three coils are digitized to produce the coin signals and are then compared with reference values stored in a programmable memory in order to discriminate between coins of different denominations, and frauds.

The disadvantage of this prior art arrangement is that the use of a voltage controlled oscillator and phase locked loop consumes substantial amounts of electrical power.

SUMMARY OF THE INVENTION

Coin discrimination apparatus in accordance with the invention includes means defining a path for the passage of coins under test, with sensor coil means for forming an inductive coupling with coins under test during their passage along the path. The sensor coil means are connected in a resonant circuit which exhibits a resonant frequency that varies in dependence upon the inductive coupling between the coil and coin. Control means are provided for maintaining the resonant circuit at the resonant frequency whilst the coin under test is inductively coupled to said coil means, and amplitude responsive means responds to the change in amplitude of an oscillatory signal developed by the resonant circuit when the coin under test passes the sensor coil means. In accordance with the invention the control means includes threshold detecting means responsive to the oscillatory signal crossing a given threshold level for producing a rectangular waveform corresponding to said oscillatory signal, and drive means are provided, responsive to said rectangular waveform for driving the resonant circuit to maintain resonance.

Thus, in accordance with the invention, the use of a phase locked loop and voltage controlled oscillator is avoided; the apparatus according to the present invention consumes much less power.

Preferably, the drive means includes bistable circuit means having first and second stable states and being configured to be clocked between said states in response to said rectangular waveform, and means for feeding back the output of said bistable means so as to improve the rectangularity of said rectangular waveform. When the invention is embodied in CMOS circuitry, this feature has the advantage of positively driving the circuitry rapidly between the two stable states. CMOS circuitry consumes low power in the two states but has an increased power consumption during switchover between the states. Thus, by forcing rapid changes of state, power consumption is reduced.

BRIEF DESCRIPTION OF THE DRAWINGS

In order that the invention may be more fully understood, an embodiment thereof will now be detailed by way of example with reference to the accompanying drawings in which:

FIG. 1 is a schematic view of a multi-coin validator in accordance with the invention;

FIG. 3 is a graph showing how the frequency and amplitude of the oscillation produced by one of the resonant circuits shown in FIG. 1 deviates with time.

DESCRIPTION OF EMBODIMENT

Figure 2:
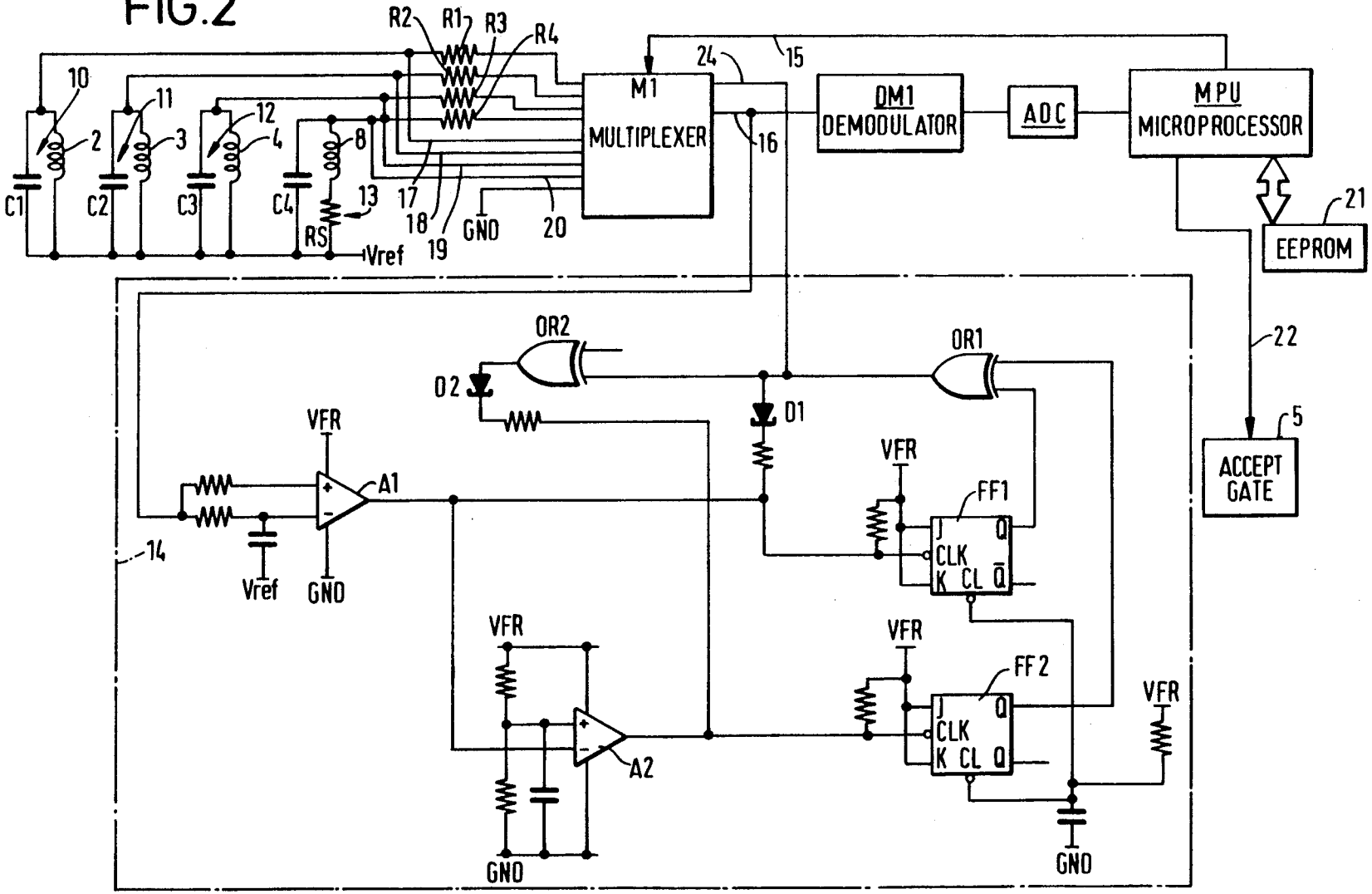
FIG. 2 is a schematic circuit diagram of discrimination circuitry connected to the sensor coils shown in FIG. 1.

Referring to FIG. 1, the apparatus consists of a coin path 1 along which coins under test roll edgewise past first, second and third sensor coils 2, 3, 4. If the coin detected by the sensor coils is identified to be a true coin, a solenoid operated accept gate 5 is opened to allow the coin to pass along the path 1*a* down an accept chute 6. If the coin is identified to have non-acceptable characteristics such as a fraudulent coin, the gate 5 is not opened and the coin passes along a path 1*b* to a reject chute 7.

An accept coil 8 is provided in the accept chute 6, which is energized in such a manner as to detect the presence of acceptable coins in order to confirm to the circuitry of FIG. 2 that a coin has been correctly accepted.

Sensor coils 2 and 3 are disposed on opposite sides of the coin path 1 and the coil 4 is arranged to wrap around the path such that its axis is parallel to the length thereof. The three coils are energized at different but relatively close frequencies F1, F2, F3 in the KHz range.

This general configuration is described in more detail in U.S. Pat. No. 4,754,862.

As shown in FIG. 2, the coils 2, 3, 4 and 8 are each connected in a respective parallel resonant circuit 10 to 13 containing capacitors C1 to C4. Each of the resonant circuits 10 to 13 has its own natural resonant frequency when no coins are in proximity to the coils 2, 3, 4, 8. Each of the resonant circuits 10 to 13 is connected through a multiplexer M1 to control circuitry 14 which maintains the resonant circuit at its natural resonant frequency. The multiplexer M1 is controlled by a microprocessor MPU by means of control signals applied on line 15.

In the absence of a coin, the apparatus operates in an idle mode in which the microprocessor MPU causes the multiplexer M1 to switch the resonant circuits 10 to 13 sequentially to the control circuit 14. The oscillatory signal developed by a particular resonant circuit is connected by the multiplexer M1 to line 16 and fed to a demodulator DM1. During the idle mode, the signal developed on line 16 for a particular resonant circuit has a substantially constant frequency and amplitude, determined by parameters of the resonant circuit concerned and also the ambient temperature of the sensor coil therein, as explained in more detail in co-pending U.S. patent application Ser. No. 07/526 062 assigned to the assignee of the present application, the contents whereof are incorporated herein by reference.

Thus, in the idle mode, the signal from resonant circuit 10 is applied on a line 17 through the multiplexer to line 16. Thereafter, the oscillatory signal from resonant circuit 11 is applied on line 18 to line 16. Subsequently, the signals developed on lines 19 and 20 are applied to the line 16.

The respective sequential outputs produced by the modulator DM1 are applied to an analogue to digital converter circuit ADC and the resulting digitised signals are applied to the microprocessor MPU and are used as a reference for example as explained in our aforesaid U.S. Application.

When a coin enters the coin path 1, the apparatus is switched from the idle mode to a coin sensing mode in which characteristics of the coin are detected. Considering for example the case of the resonant circuit 10, when a coin rolls past the coil 2, an inductive coupling is formed between the coil 2 and the coin such that the impedance presented by the coil to the resonant circuit is modified. Consequently, both the frequency and amplitude of the oscillation produced on line 17 deviates with time in the manner shown schematically in FIG. 3. The change in impedance occurs by virtue of skin effect type eddy current being induced by the coil in the coin. The magnitude and frequency of the amplitude deviations are dependent upon the relative sizes of the coil and the coin, the coin diameter and thickness, the metal from which the coin is made and the surface pattern embossed on the coin. Thus, as the coin passes the coil 2, there is a transitory deviation of the natural resonant frequency for the resonant circuit 10. The control circuit 14, operates to maintain resonance in the circuit 10 at its varying, natural resonant frequency. The manner of operation of the circuit 14 will be explained in more detail hereinafter. As a result, the output from the resonant circuit 10 on line 16 deviates substantially in amplitude as the coin passes the coil 2, mainly in accordance with the change in resistive component of the sensing coil impedance. This amplitude deviation is used as a parameter indicative of the size, metallic content and the embossed pattern on the coin.

The oscillatory signal on line 15 is demodulated by demodulator DM1 and digitized by the circuit ADC. The analogue to digital converter ADC operates repetitively so as to sample the signal on line 15 and permit the microprocessor MPU to store signals indicative of the peak deviation of amplitude as the coin passes the coil 2.

The coin then passes from coil 2 to coil 3 and the microprocessor switches the multiplexer M1 via line 15 so that the process is repeated for the coil 3. The process is thereafter repeated for coil 4.

The resonant circuit 13 which includes the accept coil 8, is utilised to detect that the coin, if accepted, passes to the accept chute 6.

As explained in U.S. Pat. No. 4,754,862, a substantially unique set of amplitude deviations produced by the circuits 10, 11, 12 characterise the coin denomination. Sets of digital values which characterise acceptable values of these amplitude deviations for different coin denominations are stored in a EEPROM 21 and are compared by the microprocessor MPU with the values derived from the output of analogue to digital converter ADC for an actual coin under test. If the microprocessor determines the presence of an acceptable coin, it provides an output on line 22 to open the solenoid operated accept gate 5.

The manner in which the control circuit 14 maintains the resonant circuits 10 to 13 in resonance will now be explained.

Figure 4A:
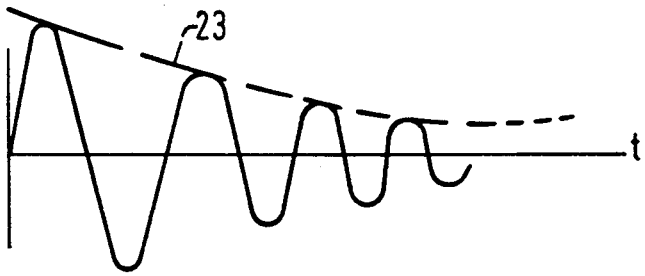
FIGS. 4A–4F show various waveforms developed in use of the apparatus.
Figure 4B:
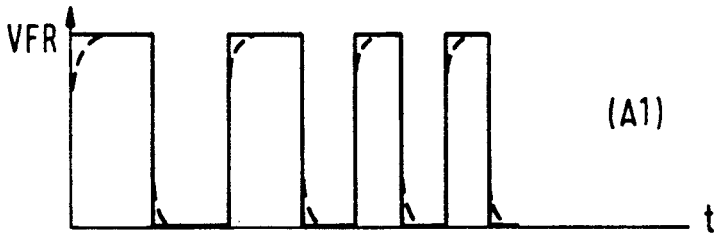
Figure 4C:
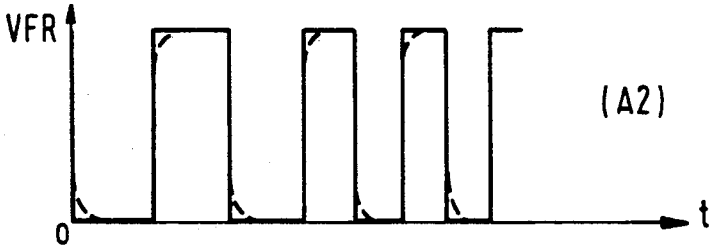

Considering for example the resonant circuit 10, in the coin sensing mode, when a coin passes the coil 2, the oscillatory signal developed on line 17 varies substantially as shown in FIG. 4A. Thus, the amplitude and frequency both deviate with time. The demodulator DM1 detects the envelope of the signal shown in dotted line 23. As previously explained, the natural resonant frequency of the circuit 10 varies as the coin passes the coil 2, due to the inductive coupling between the coil and the coin. The function of circuit 14 is to apply a cyclic rectangular energising waveform to the resonant circuit 10 via line 24, the multiplexer 1 and resistor 1. This rectangular energising waveform is shown in FIG. 4F, and it can be seen that its frequency tracks the variation in natural resonant frequency exhibited by the waveform shown in FIG. 4A. As explained in U.S. Pat. No. 4,754,862, by causing the energising waveform to track the varying natural resonant frequency, an increased amplitude deviation for envelope 23 is produced which provides an improved discrimination between true and fraudulent coins.

The multiplexer 1 connects the signal on line 17 (FIG. 4A) onto line 16 such that it is fed to a threshold detector in the form of a differential amplifier A1 connected to operate as a zero crossing detector. The output of the zero crossing detector A1 is shown in FIG. 4B. The output is a rectangular waveform for which the rectangular pulses correspond in phase and width to the positive and negative going half cycles of the oscillatory signal shown in FIG. 4A. The characteristics of the zero crossing detector A1 are such that it produces pulses having relatively slowly rising leading edges but relatively fast falling, rectangular trailing edges. Thus, the detector A1 would have a natural output characteristic as shown in dotted outline in FIG. 4B. However, the output of the detector A1 is made more rectangular at its leading edges as shown in FIG. 4B by special circuit measures, which will be described in more detail hereafter.

Figure 4D:
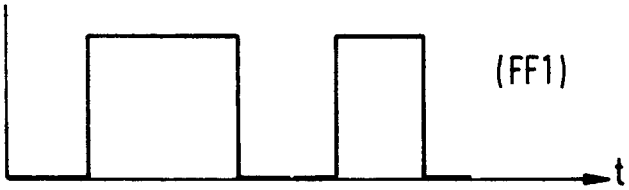

The output of detector A1 is applied to the clock input of a flip-flop FF1 which toggles on the trailing edge of the pulses shown in FIG. 4B so as to produce the rectangular waveform shown in FIG. 4D.

Figure 4E:
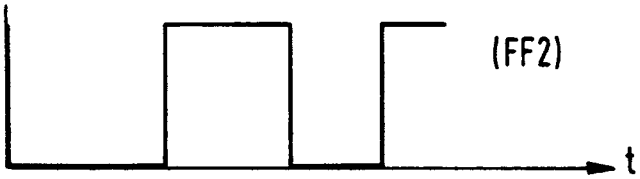
Figure 4F:
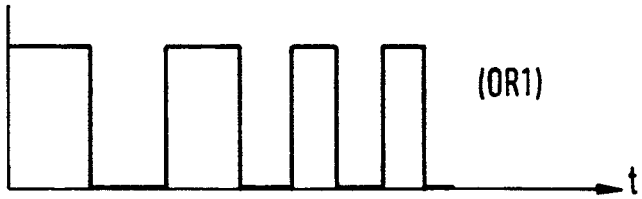

Also, the output of detector A1 is applied to an inverter stage A2 which produces the output shown in FIG. 4C. This is applied to a clock input of flip-flop FF2 which triggers on the trailing edge to produce the rectangular waveform shown in FIG. 4E. The outputs of the flip-flops FF1, 2 are applied as inputs to an exclusive OR gate OR1 which has the property of changing its output state in response to each change of state of either of its inputs. Thus, the exclusive OR gate OR1 produces the output shown in FIG. 4F. This is applied on line 24 through the multiplexer M1 and resistor R1 to the resonant circuit 10 in order to maintain and track resonance of the circuit 10 during passage of a coin past the coil 2. It will seen that the waveform in FIG. 4F consists of sharply rectangular pulses which have a width and phase corresponding to the positive and negative going half cycles of the variable frequency signals shown in FIG. 4A.

The output of the exclusive OR gate OR1 (FIG. 4F) is also applied through diode D1 to the output of zero crossing detector A1. Thus, the slowly rising leading edges of the output detector A1 are forced into a sharply rectangular waveform so that the waveform shown in FIG. 4B assumes the sharply rectangular pattern shown in solid outline rather than having slowly rising leading edges as shown in dotted outline. Also, the output of the OR gate OR1 is fed through a further gate OR2 which acts as an inverter, and then through diode D2 to the output of inverter A2. As a result, the output of inverter A2 assumes the sharply rectangular form shown in FIG. 4C rather than having slowly rising leading edges as shown in dotted outline.

The circuit 14 as the advantage that it utilizes very low power levels in comparison with the voltage controller oscillator and phase lock loop described in our prior U.S. Pat. No. 4,754,862. This permits the coin validator to be used in situations which hitherto have not been considered feasible for an electronic vaildator e.g., pool tables.

Conveniently, the circuit 14 is implemented in CMOS technology. A feature of CMOS is that it consumes very low power when at its two rail voltages e.g., 0 v and 5 v. CMOS circuitry does however consume power at a higher level when running continuously at a level between the rail voltages. It will be seen that the feedback of the output of exclusive OR gate OR1 to the outputs of detector A1 and inverter A2 produces waveforms with very sharply rising and falling edges so the transition time between the rail voltages is minimized thereby minimizing power consumption.

Thus, the circuit 14 tracks the varying natural frequency of circuit 10 as the coin passes the coil 2. As previously explained, the microprocessor MPU then switches the multiplexer so that the process is repeated for resonant circuits 11 and 12 to produce data for comparison with the values stored in the EEPROM 21.

We claim:

1. Coin discrimination apparatus comprising:
means defining a path for passage of coins under test;
sensor coil means for forming an inductive coupling with coins under test during their passage along the path, said sensor coil means being connected in a resonant circuit which exhibits a resonant frequency that varies in dependence upon the inductive coupling between the coil and coin;
control means for maintaining the resonant circuit at the resonant frequency whilst a coin under test is inductively coupled to said coil means; and
amplitude responsive means responsive to the change in the amplitude of an oscillatory signal developed by the resonant circuit when the coin under test passes the sensor coil means, wherein the control means includes threshold detecting means responsive to the oscillatory signal crossing a given threshold level for producing a rectangular waveform corresponding to said oscillatory signal, and drive means responsive to said rectangular waveform for driving the resonant circuit to maintain resonance, said drive means including bistable circuit means having first and second stable states and being configured to be clocked between said states in response to said rectangular waveform, and means for feeding back the output of said bistable circuit means for modifying the rectangularity of said rectangular waveform.

2. Apparatus according to claim 1 wherein said bistable circuit means includes first and second flip-flops, the first flip-flop being configured to be clocked between its stable states in response to a falling edge of said rectangular waveform, and the second flip-flop is configured to be clocked between its stable states in response to a falling edge of an inverse of said rectangular waveform.

3. Apparatus according to claim 2 including an inverter responsive to the output of said threshold detecting means for producing said inverse of said rectangular waveform.

4. Apparatus according to claim 2 or 3 including means for logically combining the states of the flip-flop such as to produce a drive waveform for the resonant circuit to maintain resonance thereof.

5. Apparatus according to claim 4 wherein said combining means comprises an exclusive OR gate.

6. Apparatus according to claim 5 including means for applying the output of said exclusive OR gate to the output of the threshold detecting means, and means for applying the inverse of said gate output to the input of the second flip-flop.

7. Apparatus according to claim 1 wherein the threshold detecting means comprises a zero-crossing detector.

8. In a coin discrimination apparatus comprising:
means defining a path for passage of coins under test;
sensor coil means for forming an inductive coupling with coins under test during their passage along the path, said sensor coil means being connected in a resonant circuit which exhibits a resonant frequency that varies in dependence upon the inductive coupling between the coil and coin;
control means for maintaining the resonant circuit at the resonant frequency whilst a coin under test is inductively coupled to said coil means; and
amplitude responsive means responsive to the change in the amplitude of an oscillatory signal developed by the resonant circuit when the coin under test passes the sensor coil means, the improvement comprising that the control means includes threshold detecting means for detecting when the oscillatory signal crosses a given threshold level and for producing a rectangular waveform corresponding to said oscillatory signal, and drive means responsive to said detected crossings for driving the resonant circuit to maintain resonance, said drive means including bistable circuit means having first and second stables states and being configured to be clocked between said states in response to said rectangular waveform, and means for feeding back the output of said bistable circuit means for modifying the rectangularity of said rectangular waveform.

* * * * *